US007128810B2

(12) United States Patent
Hansen

(10) Patent No.: US 7,128,810 B2
(45) Date of Patent: Oct. 31, 2006

(54) ANTI-REWET PRESS FABRIC

(75) Inventor: Robert A. Hansen, Stuttgart (DE)

(73) Assignee: Albany International Corp., Albany, NY (US)

( * ) Notice: Subject to any disclaimer, the term of this patent is extended or adjusted under 35 U.S.C. 154(b) by 501 days.

(21) Appl. No.: 10/268,124

(22) Filed: Oct. 10, 2002

(65) Prior Publication Data

US 2004/0069432 A1 Apr. 15, 2004

(51) Int. Cl.
*D21F 7/08* (2006.01)
*B32B 5/16* (2006.01)
*B32B 27/12* (2006.01)

(52) U.S. Cl. ..... 162/358.2; 162/900; 428/131; 428/138; 442/394

(58) Field of Classification Search ..... 162/205–207, 162/306, 348, 358.2, 358.4, 900–904; 428/131–141, 428/124, 156; 28/110; 442/268–275, 286–294, 442/394–399; 100/37, 116, 118, 121
See application file for complete search history.

(56) References Cited

U.S. PATENT DOCUMENTS 3,657,068 A 4/1972 Ivanowicz
4,091,137 A 5/1978 Miller
4,100,248 A 7/1978 Adams
4,206,258 A 6/1980 Balcar
4,446,187 A * 5/1984 Eklund ..... 428/136
4,500,588 A * 2/1985 Lundstrom ..... 428/212
4,537,658 A 8/1985 Albert
4,541,895 A 9/1985 Albert
4,806,413 A * 2/1989 Penven ..... 428/222
4,842,905 A 6/1989 Stech
5,056,565 A * 10/1991 Kufferath ..... 139/383 A
5,232,768 A * 8/1993 Eklund et al. ..... 442/225
5,238,537 A 8/1993 Dutt
5,260,171 A 11/1993 Smurkoski
5,360,656 A 11/1994 Rexfelt et al.
5,445,746 A * 8/1995 Lee ..... 210/783
5,500,277 A 3/1996 Trokhan et al.

(Continued)

FOREIGN PATENT DOCUMENTS

EP 0 103 376 A2 7/1983

(Continued)

*Primary Examiner*—Eric Hug
(74) *Attorney, Agent, or Firm*—Frommer Lawrence & Haug LLP; Ronald R. Santucci

(57) ABSTRACT

An anti-rewet press fabric for paper and board machines includes a barrier layer such that during compression in the press nip, the water is forced through the barrier layer, but is prevented from flowing back to the paper web during expansion. The barrier layer comprises a continuous material possessing, for example square, rectangular, tetrahedral, circular or oblong conical inclusions with a smaller opening on the bottom than on the top of the structure. Each of these "funnels" effectively constitutes a one-way valve and creates a vacuum to prevent re-absorption of water by the paper sheet. Under pressure, the structure of the barrier layer allows water to flow into the cones and out of the smaller opening in the bottom. Upon expansion, the smaller opening in the bottom of the structure restricts backward water flow and creates a vacuum on the other side. The vacuum increases water retention in the press fabric and prevents rewetting of the paper sheet. Another embodiment of the invention is described herein, wherein the barrier layer exists as a separate fabric fed through a press section. In this embodiment, the "separate fabric" can just be the "conical inclusion sheet" itself. That is, the sheet itself constitutes an inventive belt having anti-rewet properties.

18 Claims, 4 Drawing Sheets

U.S. PATENT DOCUMENTS 5,628,876 A 5/1997 Ayers et al.
5,629,052 A 5/1997 Trokhan et al.
5,679,222 A 10/1997 Rasch et al.
5,693,187 A 12/1997 Ampulski et al.
5,700,356 A 12/1997 Lefkowitz
5,817,377 A 10/1998 Trokhan et al.
5,900,122 A 5/1999 Huston
6,616,812 B1 * 9/2003 Beck ..... 162/358.2
6,716,318 B1 * 4/2004 Watanabe ..... 162/358.2

FOREIGN PATENT DOCUMENTS

EP 1 041 195 10/2000
EP 1 293 602 A1 9/2002
GB 2 062 716 5/1981
WO WO 86/05219 9/1986

* cited by examiner

ANTI-REWET PRESS FABRIC

BACKGROUND OF THE INVENTION

1. Field of the Invention

The present invention relates to an anti-rewet press fabric with cone-shaped openings for use in the press section of a papermaking machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Traditionally, press sections have included a series of nips formed by pairs of adjacent cylindrical press rolls. In recent years, the use of long press nips of the shoe type has been found to be more advantageous than the use of nips formed by pairs of adjacent press rolls. This is because the web takes longer to pass through a long press nip than through one formed by press rolls. The longer the time a web can be subjected to pressure in the nip, the more water can be removed there, and, consequently, the less water will remain behind in the web for removal through evaporation in the dryer section.

In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip which can be five to ten times longer in the machine direction than one formed between two press rolls is formed. Since the long nip is five to ten times longer than that in a conventional two-roll press, the so-called dwell time of the fibrous web in the long nip is correspondingly longer under the same level of pressure per square inch in pressing force used in a two-roll press. The result of this new long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of belt.

Perhaps most importantly, the press fabrics accept the large quantities of water extracted from the wet paper in the press nip. In order to fulfill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another. One or both woven base fabrics may be of the on-machine-seamable type.

In the press section of the papermaking machine, the formed sheet is pressed to a higher dry content through consecutive press nips. The sheet is carried through the press nip together with one or several endless textile fabrics, that are commonly referred to as press fabrics.

Referring now to press fabrics, several theories have been proposed to explain what is going on in the paper web and press fabric during the pressing process itself. The exerted mechanical nip pressure is the same for both paper web and press fabric, while the hydrodynamic pressure is considerably higher in the web than in the fabric. This pressure difference provides the driving force for the transportation of the water from the web to the fabric.

The paper web, or sheet, and press fabric probably reach minimum thickness at the same time somewhat near mid nip. The sheet is considered to reach its maximum dry content at the very same moment. After that, the sheet, as well as the fabric, begin to expand.

During this expansion, a vacuum is created in the paper web and in the surface layer of the press fabric, both of which have been compressed to a minimum thickness at a maximum pressure. In response to this vacuum, water flows back from the inside and possibly base layers of the fabric to the surface layer of the fabric and into the paper sheet to reestablish the pressure balance. This expansion phase provides the driving force of the rewetting of the paper sheet inside the press nip.

In the press fabric constructions of the prior art, it is common practice to form the fabric with a surface layer facing the paper web that is considerably denser than the backside of the structure, and it has not been unusual for instance to use lengthwise oriented batt fibers on the web facing side to decrease flow resistance. High capillary forces, together with the large vacuum in the press fabric structure during the expansion phase, absorb water from an open backside structure toward the surface layer, rapidly decreasing the vacuum in the surface layer. When the vacuum of the sheet thus rises considerably during exit from the press nip and the flow resistance in the contact face of the press fabric against the sheet decreases, high rewetting and low paper dry content result.

There are prior art fabric concepts taught with cone- or funnel-shaped openings (see for example WO 86/05219 and EP 0103376), but none have small ends designed to open and close, allowing water to flow in one direction only through them, under pressure as a separate layer in the press fabric to prevent rewet.

In general, woven base fabrics are typically in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral technique disclosed in commonly assigned U.S. Pat. No. 5,360,656 to Rexflex et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Further, the spacing between lengthwise yarns may be increased at the edges of the strip, so that, when adjoining spiral turns are arranged overlappingly, there may be an unchanged spacing between lengthwise threads in the area of the overlap.

SUMMARY OF THE INVENTION

The present invention is an anti-rewet press fabric for paper and board machines. An object of this invention is to create and maintain a vacuum during the aforementioned expansion phase by counteracting the water flow to the side of the press fabric facing the paper web, thereby inhibiting rewetting. Toward this objective, applicant's anti-rewet press fabric has a layer of cones with small ends through which water is forced while in the compression zone of the press nip, and which close to prevent return and provide suction in the cones when pressure is released.

More specifically, the press fabric of the present invention includes a continuous material possessing, for example, circular, tetrahedral and/or conical inclusions with a smaller opening on the bottom than in the top of the structure. Each of these "funnels" constitutes a one-way valve and creates a vacuum to prevent re-absorption of water by the paper sheet. Under pressure, in the compression zone of the press nip, the structure allows water to flow into the conical structure and out of the smaller opening in the bottom. Upon the release of the pressure in the expansion zone of the nip, the smaller opening in the bottom of the structure restricts backward water flow and creates a vacuum on the other side. The vacuum increases water retention in the press fabric and prevents re-absorption of water into the paper sheet.

The structure can be included in the interior of a needled press fabric, exist as a substrate in a separate fabric fed through a press section, or exist as a bottom laminate in a press fabric with a fine surface comprised of needled batt, a fine woven base, or a nonwoven structure.

The press fabric can, in its simplest form, comprise a first layer—the surface layer—and a second layer—the barrier layer—which is situated underneath the surface layer. The surface layer is positioned in the press fabric to face and transport the paper web to be dewatered.

The barrier layer has, relative to the surface layer, a high flow resistance in its thickness direction. The flow resistance is such that the water and the air forced through the barrier layer during the compression of the paper web and the press fabric, due to the pressure of the press loading, is impeded from flowing back through the barrier layer to any significant extent, when vacuum is created during the expansion of the press fabric and paper web as they exit from the press nip.

That is, during compression of the press fabric in a press section in operation, the relatively high pressure is able to force water and air from the sheet and the surface structure of the press fabric through the second layer. In this connection, when a so-called vented press is used, the second layer preferably forms the bottom layer of the press fabric facing the lower press roll or vented belt in a shoe press.

In accordance with one embodiment of the present invention, the barrier layer consists of a polymeric sheet having numerous conical inclusions. These "funnels" in the sheet are so oriented and have a narrow opening in the bottom which allows the water to be let through at the highest pressure during the compression phase but effectively blocks the reverse direction water-flow that is caused by the vacuum during the expansion phase.

Another embodiment of the invention is described herein, wherein the barrier layer exists as a separate fabric fed through a press section. In this embodiment, the "separate fabric" can just be the "conical inclusion sheet" itself. That is, the sheet itself constitutes an inventive belt having anti-rewet properties.

The present invention will now be described in more complete detail, with frequent reference being made to the figures identified below.

DETAILED DESCRIPTION OF THE PREFERRED EMBODIMENT

Figure 1:
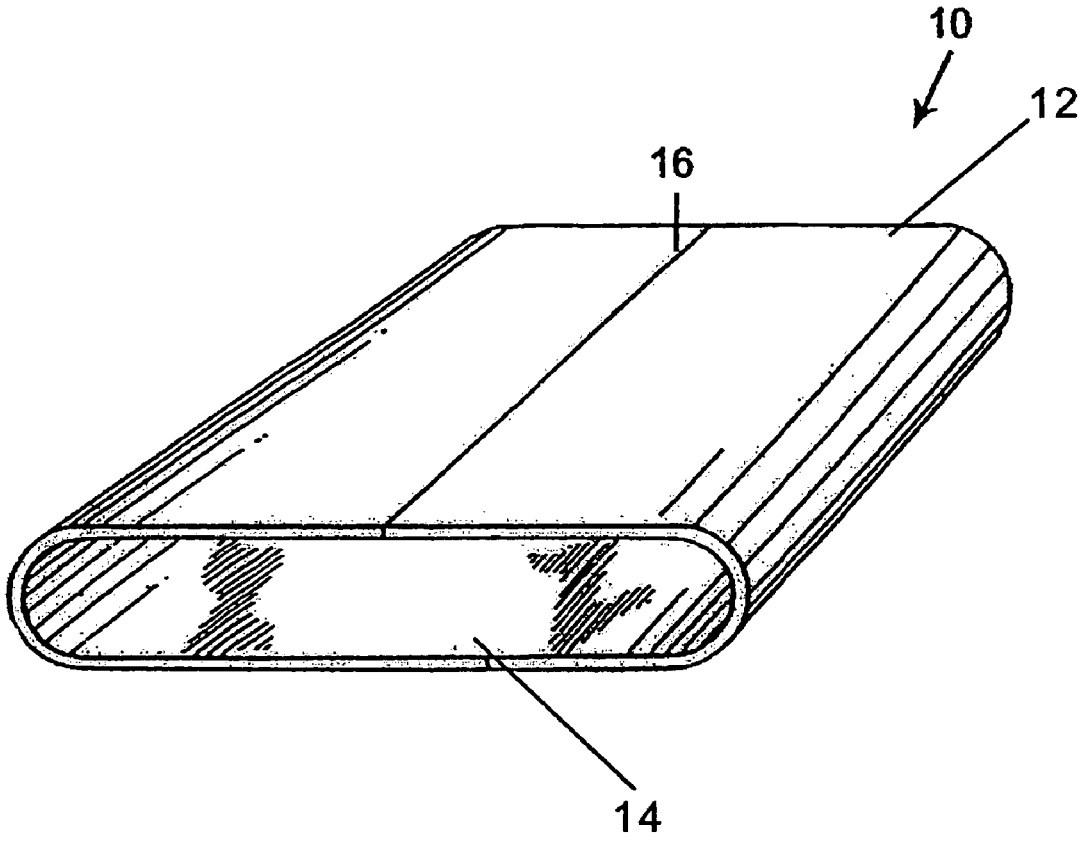
FIG. 1 is a perspective view of a press fabric.

With reference now to FIG. 1 there is generally shown a press fabric 10 having an inner surface 14 and an outer surface 12. The press fabric 10 shown is an on-machine-seamable type having a seam area 16 which may include a seaming mechanism of the type suitable for the purpose which are well known in the papermaking industry. Of course, the press fabric may also be of the type which is woven endless or spiral formed.

Figure 2:
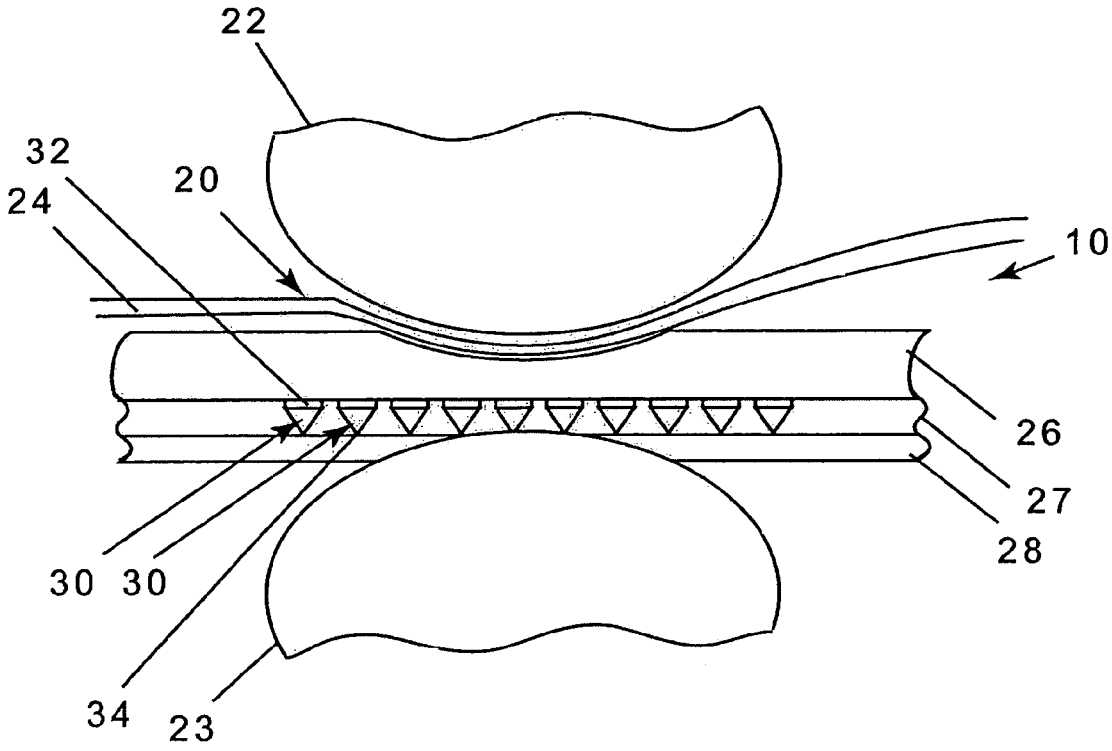
FIG. 2 is a schematic cross sectional view of the anti-rewet press fabric of the present invention in the press section of a paper machine.

With reference to FIG. 2, the press nip 20 comprises a top press roll 22 and a bottom press roll 23. The bottom press roll 23 is preferably formed with cavities in the form of suction holes with vacuum, lengthwise extending grooves or blind-drilled holes. A paper web 24 and the press fabric 10 are carried through the press nip 20.

In its most general form, shown in FIG. 2, the press fabric 10 includes a first, or surface layer 26, attached to a second, or barrier layer 27, and a base support 28 which may be an endless woven base. The surface layer 26 consists of, for example, synthetic needled fiber batt suitably reinforced for structural integrity, fine woven base or a nonwoven structure. It is positioned in immediate contact with the paper web 24. The barrier layer 27 is positioned beneath the surface layer 26, and consists of, for example, a urethane sheet having numerous conical inclusions or openings 30 with a smaller opening 34 on the bottom than the openings in the top. The layers comprising the entire press fabric can be laminated together by needling.

The function of the press nip 20 can be considered to have two phases. During the first phase, the paper web 24 as well as the press fabric 10 is compressed due to the pressure produced between the press rolls 22,23. In this compression phase, the paper web 24 and the surface layer 26 are compressed to a minimum thickness and void volume and its contents of water and air flow out from the bottom of the structure toward press roll 23.

The barrier layer 27 is also heavily compressed during the compression phase. Water and air are partly forced from the paper web 24 and the surface layer 26, and partly further through the barrier layer 27 down into the cavities in the bottom press roll 23. Water can pass through the barrier layer 27 due to the high pressure that is applied in the press nip 20 between the press rolls 22,23. That is, under pressure, water flows into the larger top opening 32 of the conical openings 30 in the barrier layer 27 and out of the smaller openings 34 in the bottom. Note that openings 30 can be arranged in the MD and CD directions at predetermined distances from each other throughout the length and width of the fabric.

When the paper web 24 and the press fabric 10 have been compressed to a maximum, near the mid-point of the press nip 20, the paper web 24 is considered to have reached its maximum dry content.

Then the second phase, the expansion phase, starts. Upon expansion, the smaller opening 34 in the bottom of each of the openings 30 restricts backward water flow and creates a vacuum on the other side of the barrier layer 27. The vacuum increases water retention in the press fabric 10 and impedes re-absorption of water into the paper sheet. Consequently, the paper web 24 may not be rewetted to any noticeable extent and a paper sheet is obtained having a higher dry content than would otherwise have been possible.

The surface layer 26 will serve to mask the openings of barrier layer 27 from the paper web and assist in transporting the paper web 24 through the press section without any objectionable paper marking.

The described embodiment of the invention is to be considered as an example only, and a number of modifications are possible. For example, the barrier layer 27 can be included in the interior of a needled press fabric, or exist as a bottom laminate in a press fabric with a fine surface comprised of needled batt, a fine woven base, or a nonwoven structure. In addition it can exist as a substrate in a separate fabric fed through the press section.

The modification wherein the barrier layer exists as a separate fabric is now described.

In this embodiment, the "separate fabric" can just be the "conical inclusion sheet" itself. That is, the sheet itself constitutes an inventive belt 27 having anti-rewet properties, as shown in FIG. 4.

Figure 4:
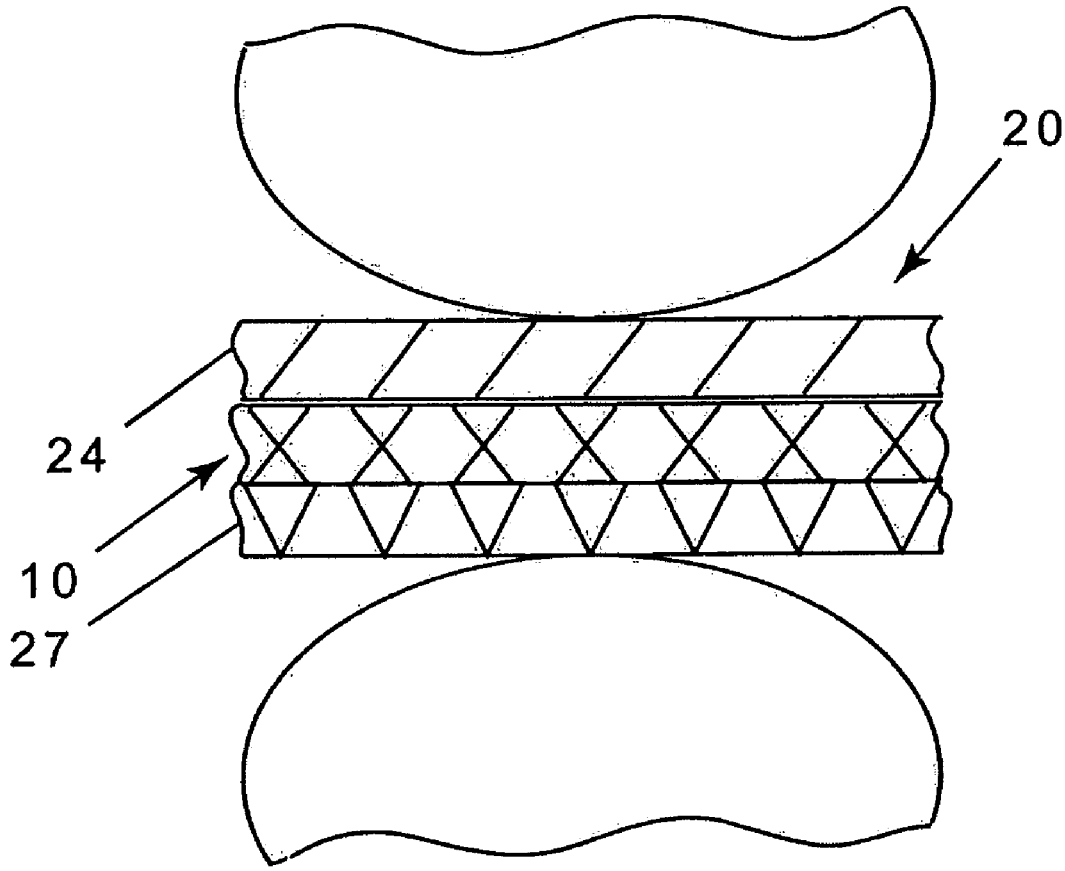
FIG. 4 is a schematic cross sectional view of the anti-rewet belt of the present invention in the press section of a paper machine.

As further illustrated in FIG. 4, a paper web 24, press fabric 10 and inventive belt 27 are carried through the press nip 20. Continuing to refer to FIG. 4, it should be understood that the inventive belt 27 is under the press fabric 10. That is, inventive belt 27 is not part of press fabric 10, as clearly shown in FIG. 4. Finally, the inventive belt 27 may further comprise a support member (not shown) for stability.

Figure 3:
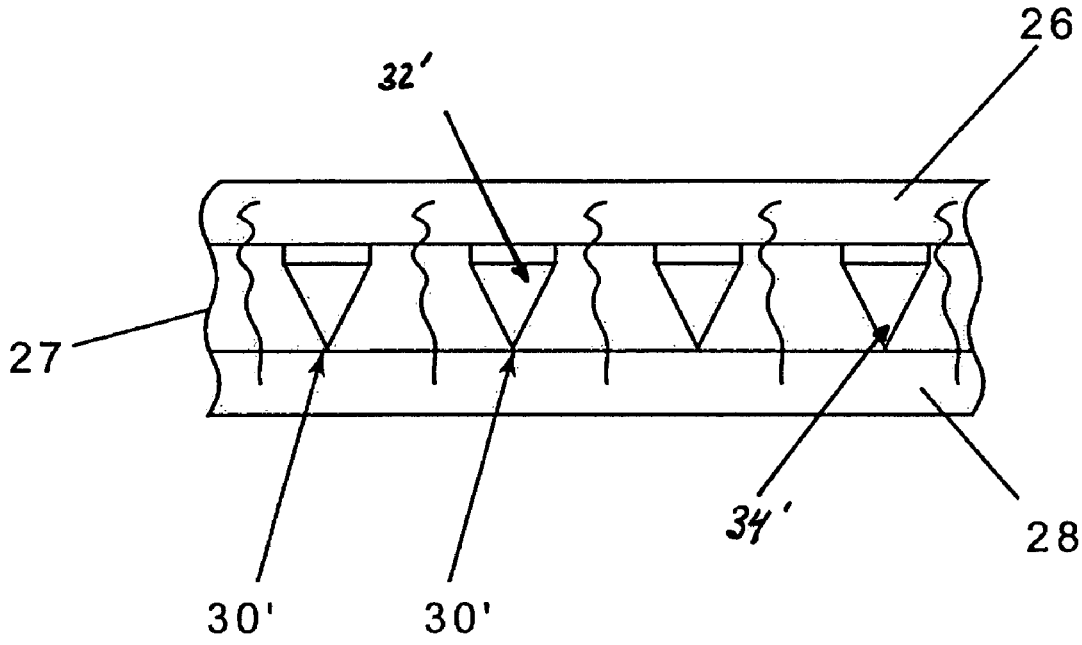
FIG. 3 is a cross sectional view of an alternative embodiment of a press fabric of the present invention.

It should be obvious that the inventive belt 27, shown in FIG. 4, inhibits rewetting in a manner similarly performed by the barrier layer 27 shown in FIG. 3. Such anti-rewet mechanism was previously discussed in great detail and, therefore, discussion of such mechanism is omitted here.

Furthermore while the openings 30 shown in FIG. 2 are conical, they may take on different shapes such as generally circular, oblong, square, rectangular and tetrahedral, as long as the top opening is larger than the bottom opening. For example, as shown in FIG. 3, openings 30' are square, rectangular, tetrahedral at top opening 32' while tapering down to bottom opening 34' which may be the same or different shape as long as it is smaller.

Thus by the present invention its objects and advantages are realized and although preferred embodiments have been disclosed and described in detail herein, its scope should not be limited thereby; rather its scope should be determined by that of the appended claims.

What is claimed is:

1. An anti-rewet press fabric for dewatering a fibrous web in the press section of a papermachine, said fabric having an inner surface and an outer surface comprising:

a first layer, said first layer being a surface layer on the outer surface for supporting said fibrous web;

a second layer, said second layer being a barrier layer beneath said surface layer and having a higher flow resistance in a thickness direction going from the inner surface to the outer surface;

said second layer being a polymeric sheet with a plurality of self supporting inclusions therethrough for the passage of water from said fibrous web and being attached to said surface layer; and each self supporting inclusion being tapered having a top opening adjacent the surface layer and a bottom opening at a distance away from the surface layer with the bottom opening being smaller than the top opening so as to impede liquid flow back to the surface layer after the press fabric exits a press nip.

2. An anti-rewet press fabric as claimed in claim 1, wherein said surface layer is comprised of needled batt.

3. An anti-rewet press fabric as claimed in claim 1, wherein said surface layer is comprised of a fine woven base.

4. An anti-rewet press fabric as claimed in claim 1, wherein said surface layer is comprised of a non-woven structure.

5. An anti-rewet press fabric as claimed in claim 1, wherein the shape of the self supporting inclusion is conical, tapering from the top opening to the bottom opening.

6. An anti-rewet press fabric as claimed in claim 5, wherein the shape of each opening is square, rectangular, tetrahedral, circular or oblong.

7. An anti-rewet press fabric as claimed in claim 1, wherein the shape of each opening is square, rectangular, tetrahedral, circular or oblong.

8. An anti-rewet press fabric as claimed in claim 1, further comprising a base fabric below said second layer, and wherein said surface layer is a non-woven batt of staple fibers needled to said second layer and said base fabric.

9. An anti-rewet press fabric as claimed in claim 1 which includes a base support having a surface layer taken from the group consisting of needled batt, fine woven base and a non-woven structure.

10. An anti-rewet press fabric as claimed in claim 9 wherein the second layer is positioned between the base support and the surface layer.

11. An anti-rewet fabric for dewatering a fibrous web in the press section of a papermachine, said fabric having an inner surface and an outer surface comprising:

a first layer, said first layer for supporting a second layer;

said second layer being a barrier layer having a higher flow resistance in a thickness direction going from the inner surface to the outer surface;

said second layer being a polymeric sheet with a plurality of self supporting inclusions therethrough for the passage of water from said fibrous web and being attached to said first layer; and each self supporting inclusion being tapered having a top opening and a bottom opening at a distance away from the top opening with the bottom opening being smaller than the top opening so as to impede liquid flow back from the bottom opening to the top opening.

12. An anti-rewet fabric as claimed in claim 11, wherein the shape of the self supporting inclusion is conical, tapering from the top opening to the bottom opening.

13. An anti-rewet fabric as claimed in claim 11, wherein the shape of each opening is square, rectangular, tetrahedral, circular or oblong.

14. An anti-rewet press fabric as claimed in claim 11 wherein the first layer is woven, non-woven, spiral formed or is a laminate.

15. An anti-rewet belt for use in dewatering a fibrous web transported by a press fabric in the press section of a papermachine, said belt having an inner surface and an outer surface;

said belt being a barrier element beneath said press fabric and having a higher flow resistance in a thickness direction going from the inner surface to the outer surface;

said belt being a polymeric sheet with a plurality of inclusions therethrough for the passage of water from said fibrous web; and each inclusion being tapered having a top opening at the outer surface and a bottom opening at a distance away from the outer surface with the bottom opening being smaller than the top opening so as to impede liquid flow back to the press fabric after it exits a press nip.

16. An anti-rewet belt as claimed in claim 15, wherein the shape of the inclusion is conical, tapering from the top opening to the bottom opening.

17. An anti-rewet belt as claimed in claim 15, wherein the shape of each opening is square, rectangular, tetrahedral, circular or oblong.

18. An anti-rewet belt as claimed in claim 15, further comprising a support member.

* * * * *